US009194244B2

(12) United States Patent
Willett, Jr.

(10) Patent No.: US 9,194,244 B2
(45) Date of Patent: Nov. 24, 2015

(54) DRUM ROTOR DOVETAIL COMPONENT AND RELATED DRUM ROTOR SYSTEM

(71) Applicant: General Electric Company, Schenectady, NY (US)

(72) Inventor: Fred Thomas Willett, Jr., Burnt Hills, NY (US)

(73) Assignee: General Electric Company, Schenectady, NY (US)

( * ) Notice: Subject to any disclaimer, the term of this patent is extended or adjusted under 35 U.S.C. 154(b) by 437 days.

(21) Appl. No.: 13/775,932

(22) Filed: Feb. 25, 2013

(65) Prior Publication Data

US 2014/0241867 A1 Aug. 28, 2014

(51) Int. Cl.

| | |
|---|---|
| ***F01D 9/00*** | (2006.01) |
| ***F01D 5/30*** | (2006.01) |
| ***F01D 11/00*** | (2006.01) |

(52) U.S. Cl.

CPC ..... *F01D 5/3007* (2013.01); *F01D 5/30* (2013.01); *F01D 5/3038* (2013.01); *F01D 11/001* (2013.01)

(58) Field of Classification Search

CPC ..... F01D 5/3007; F01D 5/3038; F01D 5/30; F01D 11/001

USPC ..... 415/115; 416/219 R, 220 R

See application file for complete search history.

(56) References Cited

U.S. PATENT DOCUMENTS

| | | | | |
|---|---|---|---|---|
| 2,790,620 | A * | 4/1957 | Rankin | 416/217 |
| 5,018,941 | A | 5/1991 | Heurtel et al. | |
| 5,139,389 | A * | 8/1992 | Eng et al. | 416/248 |
| 5,308,227 | A * | 5/1994 | Gros et al. | 416/219 R |
| 8,894,372 | B2 * | 11/2014 | Willett et al. | 416/220 R |
| 2011/0085886 | A1 * | 4/2011 | Kasibhotla et al. | 415/1 |
| 2011/0156359 | A1 * | 6/2011 | Zheng et al. | 277/418 |
| 2011/0158819 | A1 * | 6/2011 | Mani et al. | 416/96 R |
| 2012/0034102 | A1 * | 2/2012 | Boyer | 416/97 R |
| 2013/0195669 | A1 * | 8/2013 | Murdock et al. | 416/223 R |

* cited by examiner

*Primary Examiner* — Justin Jonaitis
*Assistant Examiner* — Stephen Mick
(74) *Attorney, Agent, or Firm* — Ernest G. Cusick; Hoffman Warnick LLC.

(57) ABSTRACT

Systems and devices adapted to retain dovetail components (e.g., buckets) in a turbine drum rotor and reduce rotor component displacement are disclosed. In one embodiment, a turbine bucket includes: a bucket base portion shaped to complement a bucket shank slot in a rotor of a turbine, the bucket base portion including: a forward portion shaped to extend upstream of a first stage circumferential slot of the rotor in to a first rotor post of the rotor; a circumferential protrusion formed in an aft end of the bucket base portion and shaped to connect to the rotor, and a set of axial protrusions formed on tangential sides of the bucket base portion and shaped to connect to the rotor; and a bucket platform extending radially outboard from the bucket base portion, the bucket platform configured to complement a vane.

20 Claims, 11 Drawing Sheets

DRUM ROTOR DOVETAIL COMPONENT AND RELATED DRUM ROTOR SYSTEM

FIELD OF THE INVENTION

The subject matter disclosed herein relates to turbomachines and, more particularly, to turbines and the load distribution, installation and retention of combined axial-circumferential dovetail components (e.g., buckets) in a turbine drum rotor.

BACKGROUND OF THE INVENTION

Some power plant systems, for example certain nuclear, simple cycle and combined cycle power plant systems, employ turbines in their design and operation. Some of these turbines operate at high temperatures and include rotors (e.g., a drum rotor, a wheel and diaphragm rotor, etc.) that are in direct contact with high temperature steam which may reduce the lifespan of the rotor and rotor components (e.g., buckets). These buckets are installed circumferentially about the rotor via a set of entry slots in the rotor posts and/or rims. One area of the rotor that experiences severe environmental conditions (e.g., temperatures, pressures, etc.) during operation, is the forward rotor post which is located forward of the first stage bucket. During turbine operation, the forward rotor post may creep away from the first stage bucket due to centrifugal and bending loads exerted by the first stage bucket. This creep effect may open a dovetail slot in the rotor which restrains the first stage buckets, possibly resulting in the first stage buckets becoming loose.

FIGS. 1-3 show schematic cut-away views of prior art turbine systems. FIGS. 1-2 show a prior art turbine system 50 including a stator 52 and a rotor 54 substantially defining a working fluid flow path 7 (e.g., steam flow path). Rotor 54 illustrated in FIG. 1 includes a plurality of buckets 70 disposed between a plurality of vanes 78, the buckets 70 including a first stage bucket 72 disposed in a dovetail slot 80 between a first rotor post 82 and a second rotor post 84. During operation, as shown in FIG. 2, a force imbalance 41 (e.g., a bending moment) may be exerted on first rotor post 82 as a first side 92 of first rotor post 82 is not acted upon by a bucket load and a second side 94 of first rotor post 82 is acted upon by a bucket load from first stage bucket 72. Some prior art systems, as shown in FIG. 3, increase an axial length 1' of first rotor post 82 in order to compensate for force imbalance 41 (indicated in FIG. 2), this increased length guarding against creep deflection and axial opening of dovetail slot 80. During operation, fluid flow through working fluid flow path 7 (shown in FIG. 1) may contact first stage bucket 72 and impart a force on the rotor. However, increasing length L of first rotor post 82 to counter the forces imparted on the rotor by first stage bucket 72 may require increased axial rotor span and other design considerations which may place constraints on turbine design and manufacture.

BRIEF DESCRIPTION OF THE INVENTION

Systems and devices adapted to retain dovetail components (e.g., buckets) in a turbine drum rotor and reduce rotor component displacement are disclosed. In one embodiment, a turbine bucket includes: a bucket base portion shaped to complement a bucket shank slot in a rotor of a turbine, the bucket base portion including: a forward portion shaped to extend axially upstream of a first stage circumferential slot of the rotor into a first rotor post of the rotor; a circumferential protrusion formed in an aft end of the bucket base portion and shaped to connect to a circumferential slot in the rotor, and a set of axial protrusions formed on tangential sides of the bucket base portion and shaped to connect to axial slots in the rotor; and a bucket platform extending radially outboard from the bucket base portion, the bucket platform configured to connect to a vane.

A first aspect of the disclosure provides a turbine bucket including: a bucket base portion shaped to complement a bucket shank slot in a rotor of a turbine, the bucket base portion including: a forward portion shaped to extend axially upstream of a first stage circumferential slot of the rotor into a first rotor post of the rotor; a circumferential protrusion formed in an aft end of the bucket base portion and shaped to connect to a circumferential slot in the rotor, and a set of axial protrusions formed on tangential sides of the bucket base portion and shaped to connect to axial slots in the rotor; and a bucket platform extending radially outboard from the bucket base portion, the bucket platform configured to connect to a vane.

A second aspect provides a turbine including: a stator; a working fluid passage substantially surrounded by the stator; and a rotor located radially inboard of the working fluid passage and including a first rotor post and a second rotor post, the rotor including: a set of turbine buckets connected to the rotor via the first rotor post and the second rotor post, the set of turbine buckets including: a bucket base portion shaped to complement a bucket shank slot in the rotor, the bucket base portion including: a forward portion shaped to extend upstream of a first stage circumferentially-oriented slot of the rotor in to the first rotor post of the rotor; a circumferentially-oriented protrusion formed in an aft end of the bucket base portion and shaped to connect to the rotor, and a set of axially-oriented protrusions formed on tangential sides of the bucket base portion and shaped to connect to the rotor; and a bucket platform extending radially outboard from the bucket base portion, the bucket platform configured to complement a vane.

A third aspect provides a rotor including: an axle configured to extend through a flow path of a turbine and support a plurality of turbine components; a first rotor post disposed circumferentially about the axle and shaped to partially define a first stage circumferential retention slot for a set of turbine buckets, the first rotor post defining a plurality of bucket shank slots which extend axially through the first rotor post and are shaped to complement a turbine bucket; and a second rotor post disposed circumferentially about the axle and located downstream of the first rotor post relative to a working fluid flow in the turbine, the second rotor post shaped to complement the first rotor post and partially define the first stage circumferential retention slot.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

Figure 1:
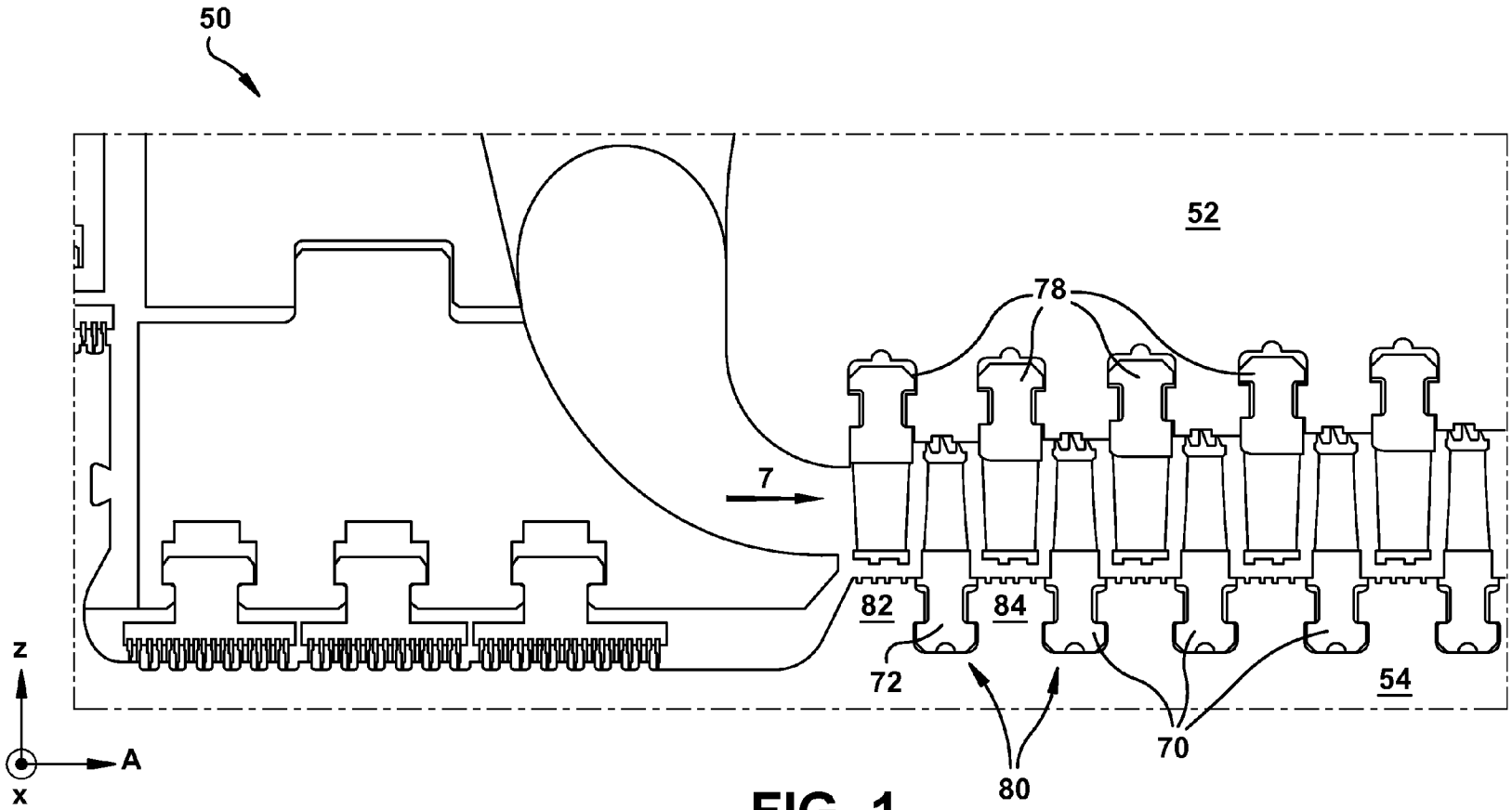
FIG. 1 (Prior Art)
FIG. 1 shows a partial cut-away schematic view of a turbine according to the prior art.
Figure 2:
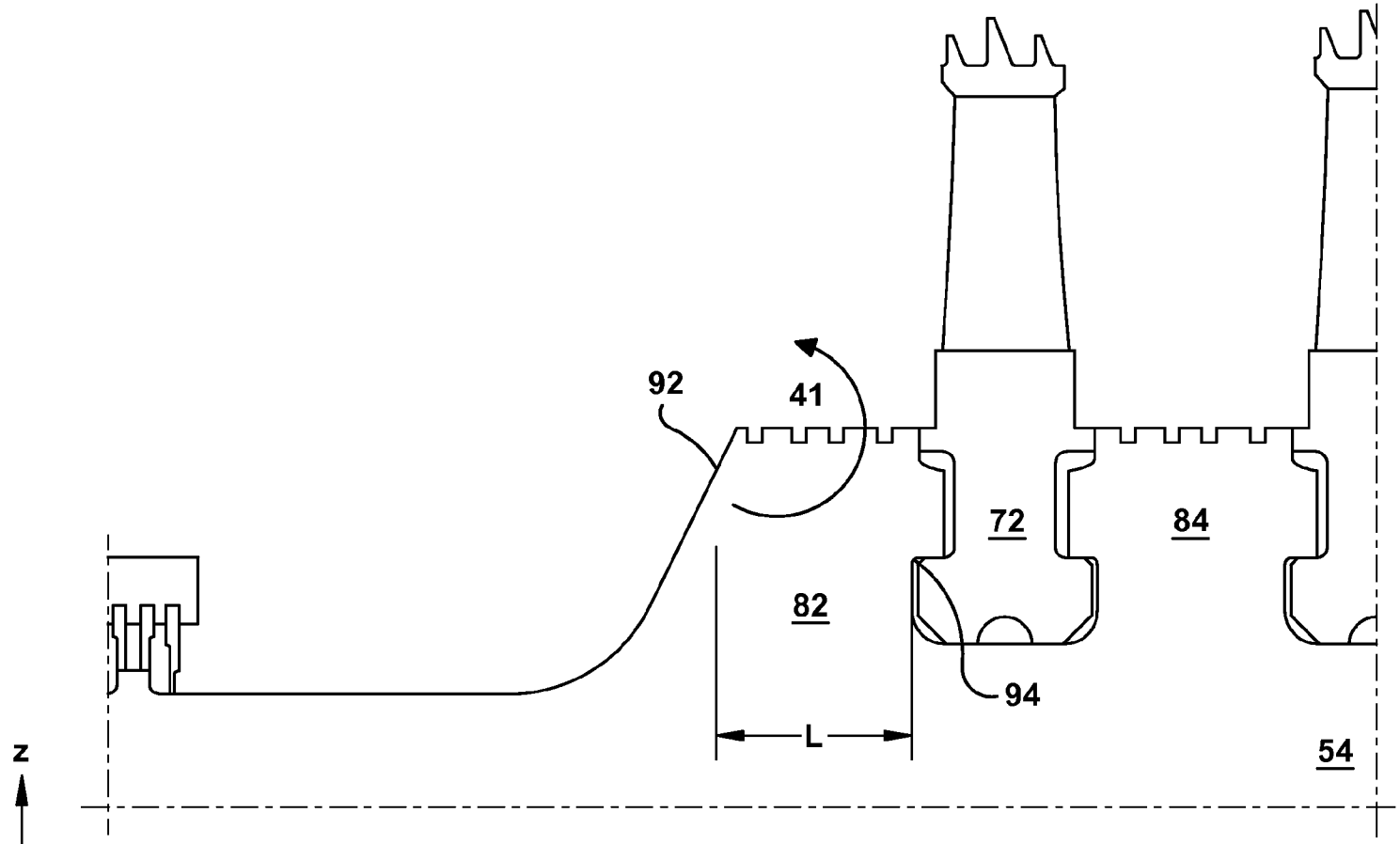
FIG. 2 (Prior Art)
FIG. 2 shows a partial cut-away schematic view of a turbine and rotor post according to the prior art.
Figure 3:
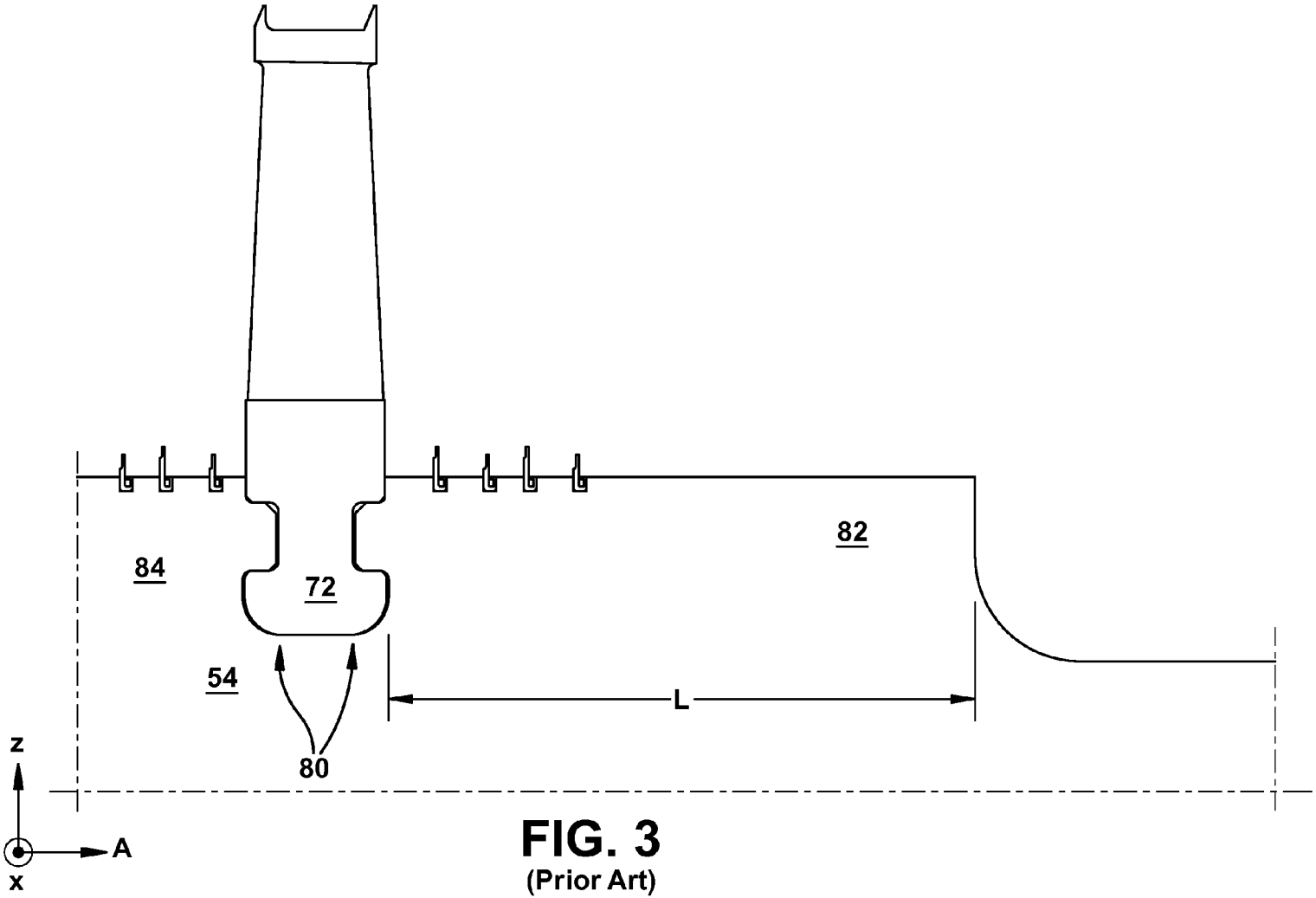
FIG. 3 (Prior Art)
FIG. 3 shows a partial cut-away schematic view of a turbine and rotor post according to the prior art.
Figure 4:
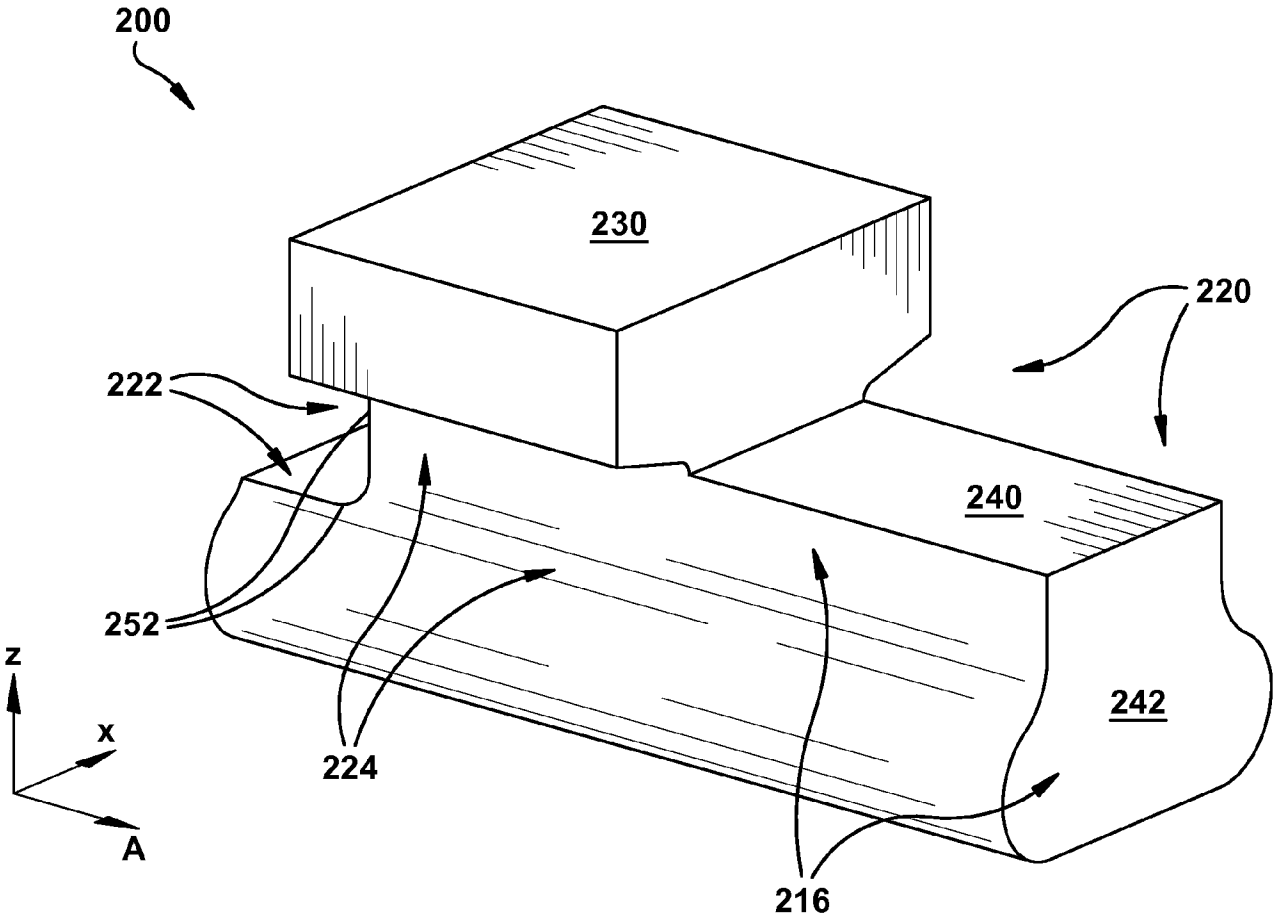
FIG. 4 shows a three-dimensional perspective view of portions of a turbine bucket according to an embodiment of the invention.

It is noted that the drawings of the invention are not necessarily to scale. The drawings are intended to depict only typical aspects of the invention, and therefore should not be considered as limiting the scope of the invention. It is understood that elements similarly numbered between the FIGURES may be substantially similar as described with reference to one another. Further, in embodiments shown and described with reference to FIGS. 1-11, like numbering may represent like elements. Redundant explanation of these elements has been omitted for clarity. Finally, it is understood that the components of FIGS. 1-11 and their accompanying descriptions may be applied to any embodiment described herein.

DETAILED DESCRIPTION OF THE INVENTION

As indicated herein, aspects of the invention provide for systems and devices adapted to reduce turbine component displacement and increase rotor and rotor component lifespan by improving turbine bucket retention and load distribution (e.g., altering and distributing a load profile on a forward/upstream rotor portion of a rotor). The turbine buckets of these systems are installed in a circumferential slot about the rotor via a set of entry slots, and include a set of axial protrusions and a set of circumferential protrusions configured to matingly connect to the rotor. These axial and circumferential protrusions provide each turbine bucket with a plurality of contact surfaces with the rotor through which operational loads and moments may be distributed. The rotor includes a set of axial flanges and a set of circumferential flanges which define slots configured to connect with the protrusions, these slots and protrusions retain the turbine bucket therein and distribute and dissipate forces and loads from the turbine bucket. This connection reduces load moments, stress concentrations, and the potential for displacement (e.g., creep) in the first rotor portion (e.g., the upstream rotor post) and constrains the first stage turbine bucket within the rotor. In an embodiment, a set of chamfers/notches/apertures may be formed through a bucket platform of the turbine bucket to provide flow access to the bucket base portion, protrusions, slots, and dovetail features.

As used herein, the directional key in the lower left-hand portion of FIGS. 1-11 is provided for ease of reference. As shown, this key is oriented with respect to the close-up views of portions of steam turbine support assemblies described herein. For example, as used in FIGS. 1-11, which show views of steam turbine assemblies, the "z" axis represents vertical (or radial) orientation, "x" represents horizontal (or circumferential) orientation, and the "A" axis represents axial orientation (along the axis of the turbine rotor, omitted for clarity).

Turning to the FIGURES, embodiments of systems and assemblies including axial-circumferential turbine buckets are shown, where protrusions (e.g., dovetails) in the turbine buckets may impact rotor assembly installation and increase the life expectancy of the rotor, the turbine and the overall power generation system by reducing force imbalances in the assembly. Each of the components in the FIGURES may be connected via conventional means, e.g., via a weld, integral casting, or other known means as is indicated in FIGS. 4-11. Specifically, referring to FIG. 4, a three-dimensional perspective view of a turbine bucket 200 (shown for clarity without the vane) including a bucket base portion 220 and a flow portion 230 (e.g., a bucket platform) is shown according to embodiments of the invention. Bucket base portion 220 includes a set of axial protrusions 224 (e.g., axially oriented protrusions, hooks, etc.) which are shaped to connect to a rotor 210 (shown in FIG. 5) and secure turbine bucket 200 to rotor 210. Bucket base portion 220 may extend axially upstream relative to a flow 7 (shown in FIG. 5) and may also define a set of circumferential protrusions 222 (e.g., circumferentially oriented protrusions, hooks, etc.) which are adapted to connect to rotor 210 (shown in FIG. 5) and secure turbine bucket 200 to rotor 210. Axial protrusions 224 and circumferential protrusions 222 may share loading on turbine bucket 200 across rotor 210, providing a plurality of contact surfaces there between. Bucket platform 230 may extend over and/or partially define axial protrusions 224 and circumferential protrusions 222 which may matingly connect with axial flanges 280 and circumferential flanges 322 (shown in FIG. 5 defining slots) formed in rotor 210.

Turbine bucket 200 may further include a first rotor post flow surface 240 and a second rotor post flow surface 242. First rotor post flow surface 240 may be formed on a radial surface of bucket base portion 220 and may contact a working fluid (e.g., steam) flowing through the turbine 300 (shown in FIG. 5). In an embodiment, first rotor post flow surface 240 may be substantially radial with a flow surface of a mating rotor (e.g., first rotor post portion), thereby forming a substantially smooth and/or continuous flow surface for working fluid flow path 7. Second rotor post flow surface 242 may be the axial surface of bucket base portion 220 and may contact a flow through the turbine. In an embodiment, second rotor post flow surface 242 may be substantially coplanar with a flow surface of a mating rotor (e.g., first rotor post portion), thereby forming a substantially smooth and/or continuous flow surface for working fluid flow path 7. Bucket platform 230 may include a vane 232 (shown in FIG. 5) which extends into working fluid flow path 7.

In various embodiments, bucket base portion 220 may include a forward portion 216 which is shaped and/or sized to extend within a first rotor post (e.g., within a bucket shank slot). Axial protrusions 224 may extend across bucket base portion 220 including forward portion 216 and may include a set of contact surfaces 254 (shown in FIG. 5) which secure turbine bucket 200 to rotor 210 by defining set of axial protrusions 224. The set of contact surfaces may be substantially tangential (e.g., surfaces which are not entirely circumferential or radial), substantially radial, and/or substantially circumferential. In one embodiment, set of axial protrusions 224 may include dovetail features (e.g., a traditional T-root dovetail) configured to complement a first rotor post of rotor 210. In an embodiment, circumferential protrusion 222 is located at an aft end of turbine bucket 200 and may include a set of contact surfaces 252 shaped to connect to a complementary slot/ridge formed in a second rotor post of rotor 210. In this manner, turbine bucket 200 may be connected to rotor 210 circumferentially via set of circumferential protrusions 222 and axially via set of axial protrusions 224.

Figure 5:
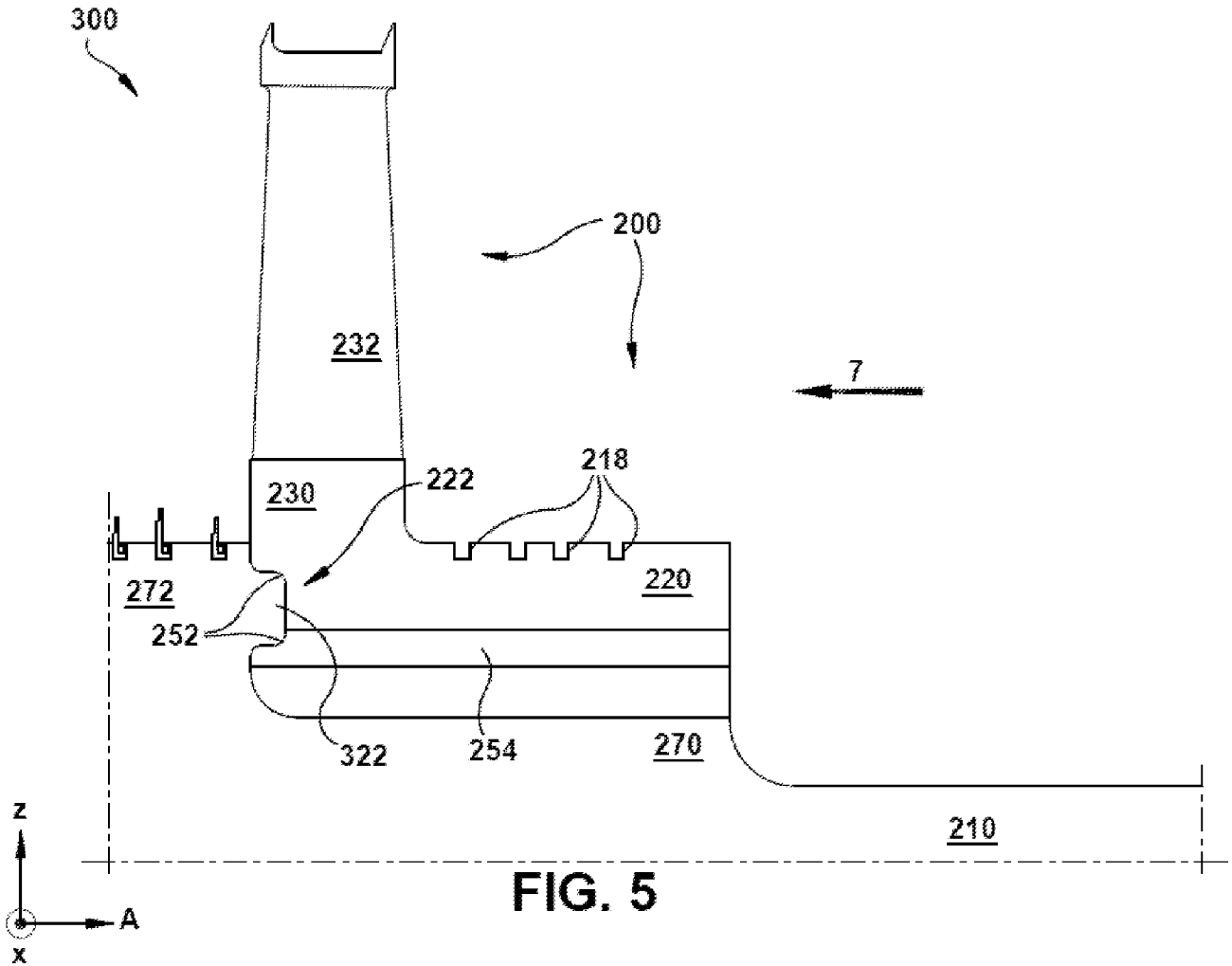
FIG. 5 shows a partial cut-away schematic view of portions of a turbine according to an embodiment of the invention.

Turning to FIG. 5, a cross-sectional view of portions of a turbine 300 is shown including turbine bucket 200 connected to rotor 210 according to embodiments of the invention. Bucket base portion 220 may complement a portion of first rotor post 270 and bucket platform 230 may include a vane 232 which extends in to working fluid flow path 7. In this embodiment, a set of circumferential protrusions 222 is connected to a circumferential flange 322 which extends from a second rotor post 272 of rotor 210. As can be seen, a set of circumferential surfaces 252 (e.g., surfaces which extend/are oriented substantially circumferentially) matingly receive circumferential flange 322 (e.g., form a complementary dovetail) and connect turbine bucket 200 to second rotor post 272. In an embodiment, the set of tangential surfaces 254 which substantially form axial protrusion 224 may contact a set of axial flanges 280 (shown in FIGS. 6 and 7) formed in first rotor post 270. Forward portion 216 may define a set of J-seal grooves 218 which may be oriented substantially circumferentially about rotor 210. Set of J-seal grooves 218 may connect to a set of J-seals which assist to retain turbine bucket 200 within rotor 210 as described herein.

Figure 6:
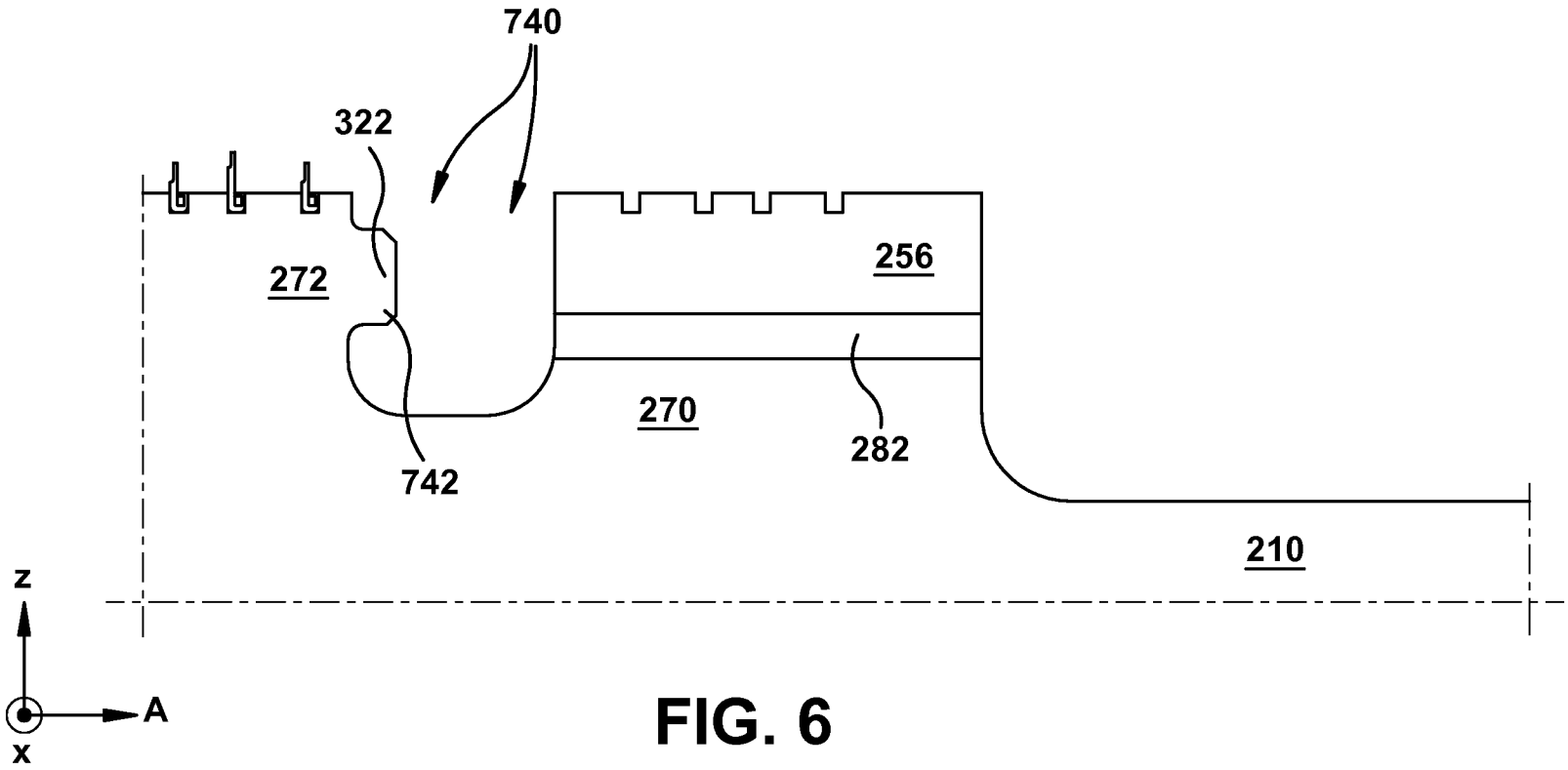
FIG. 6 shows a partial cut-away schematic view of portions of a turbine according to an embodiment of the invention.

Turning to FIG. 6, a cross-sectional view of portions of rotor 210 is shown including a bucket shank slot 740 disposed between/defined by first rotor post 270 and second rotor post 272 according to embodiments of the invention. Circumferential flange 322 may extend axially into rotor circumferential slot 740, thereby providing a moment surface 742 located to contact axial surfaces 252 and reduce a force of a bending moment imparted by turbine bucket 200. In an embodiment, first rotor post 270 may include surfaces 256 which may extend to provide a retention surface 282 which partially defines a first rotor post slot 840 (shown in FIG. 7). First rotor post slot 840 (shown in FIG. 7) and/or tangential surfaces 256 may substantially complement and/or matingly connect to bucket base portion 220 and set of axial protrusions 224. In various embodiments, axial protrusions 224 may contact retention surface 282 and distribute a force and/or moment generated by turbine bucket 200 there through. It is understood that turbine bucket 200 may be retained in bucket shank slot 740 using any now known or later developed techniques including axial surfaces 322, J-seal strips, tangential surfaces 254, etc.

Figure 7:
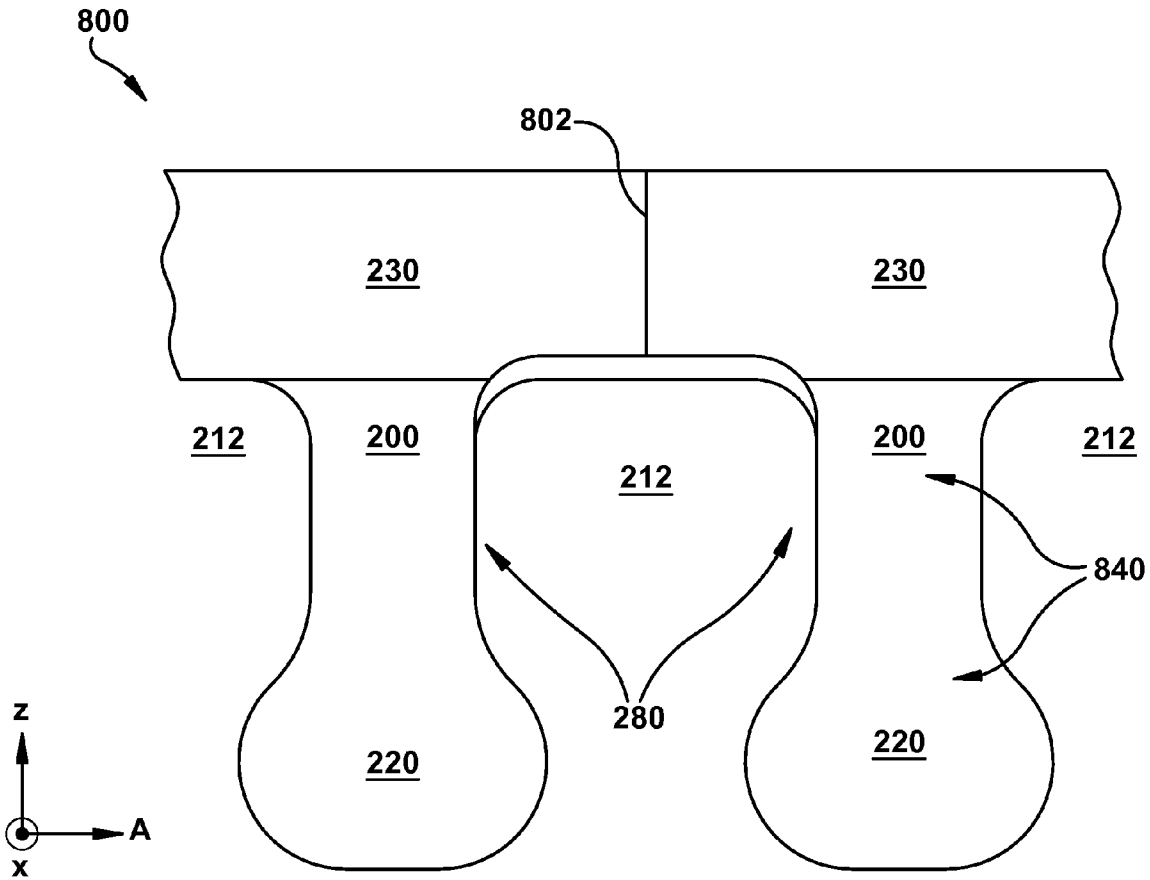
FIG. 7 shows a partial cut-away schematic view of portions of a rotor according to an embodiment of the invention.

Turning to FIG. 7, a cross-sectional view of a portion of a turbine 800 is shown including rotor 210 connected to a set of turbine buckets 200 according to embodiments of the invention. In an embodiment, rotor 210 may include a set of posts 212 which in combination with a set of turbine buckets 200 form a continuous first rotor post 270 (shown in FIGS. 5-6) and include tangential ridges 280 which form first rotor post slot 840. In one embodiment, first rotor post slot 840 may be formed through the rotor and may eliminate the need for a closure bucket, and bucket shank slot 740 may allow first rotor post slot 840 to be formed/produced as a through cut rather than a blind cut. This combination of slots 740 and 840 connecting with turbine bucket 200 to form a combined axial-circumferential connection (e.g., dovetail). Tangential ridges 280 may be shaped to form a dovetail configured to matingly receive bucket base portion 220 of turbine bucket 200 and to contact axial protrusions 224 for retention and/or force distribution of loads and moments imparted on and by turbine bucket 200. Turbine bucket 200 may be retained within rotor 210 and first rotor post slot 840 via mating of the dovetail shape of bucket base portion 220 and the complementary dovetail shape of first rotor post slot 840. Bucket platform 230 of turbine bucket 200 may extend above first rotor post slot 840 and across set of posts 212. In one embodiment, bucket platforms 230 of adjacent turbine buckets 200 may contact and/or form an interface 802 on top of a post 212. Bucket base portion 220 may be inserted into first rotor post slot 840 where it is slidingly received by retention surfaces 282 (shown in FIG. 6) and circumferential protrusion 322 of rotor 210. In one embodiment, bucket base portion 220 and set of posts 212 may form a substantially continuous circumferential post about rotor 210.

Figure 8:
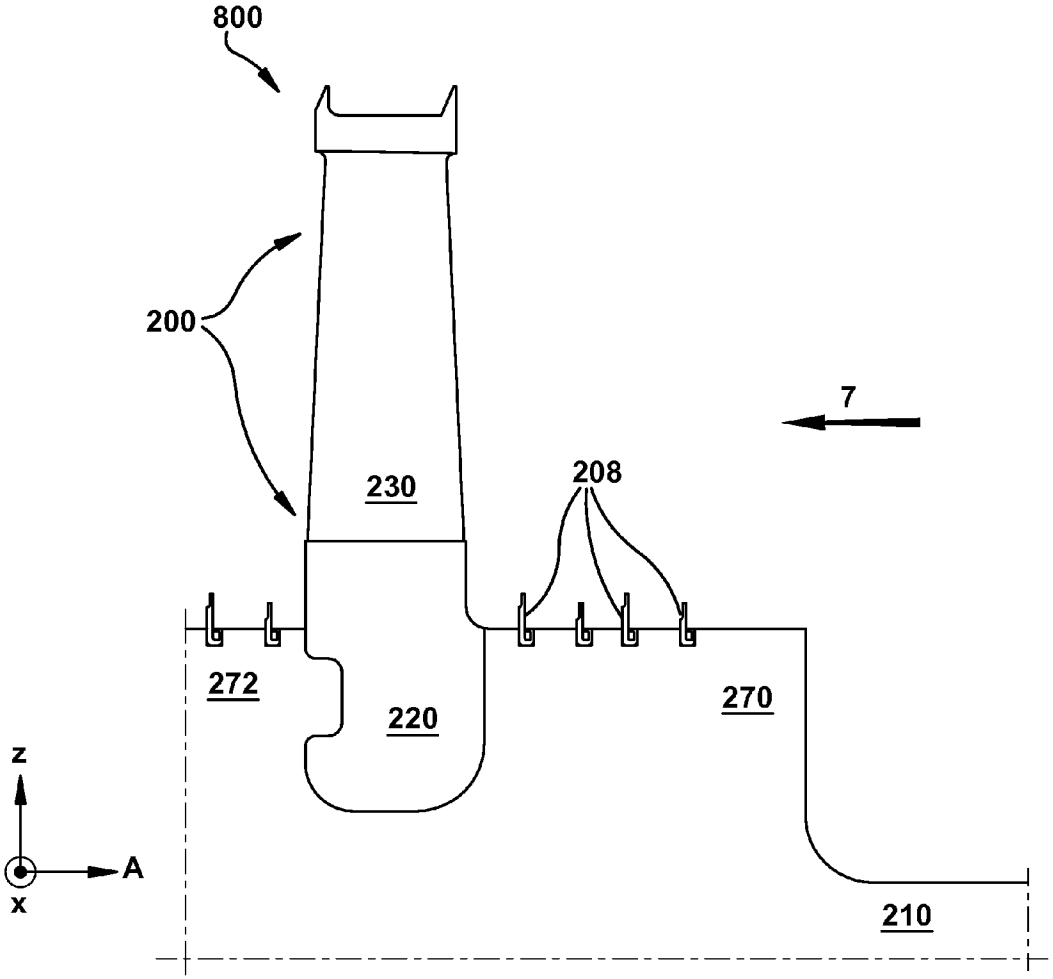
FIG. 8 shows a partial cut-away schematic view of portions of a turbine according to an embodiment of the invention.
Figure 9:
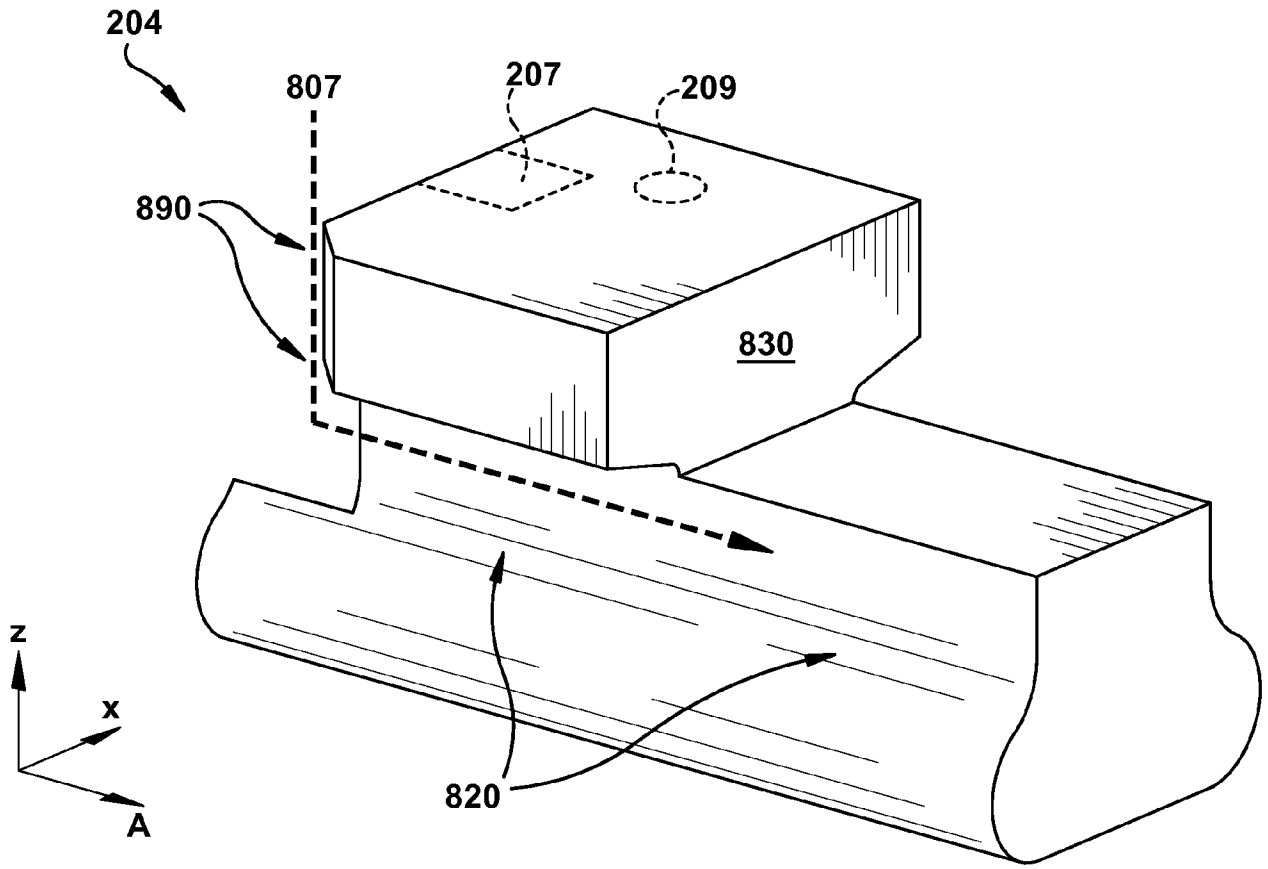
FIG. 9 shows a three-dimensional perspective view of portions of a turbine bucket according to an embodiment of the invention.

Turning to FIG. 8, a cross-sectional view of portions of turbine 800 is shown including rotor 210 connected to turbine bucket 200 according to embodiments of the invention. In this embodiment, bucket base forward portion 216 (shown in FIG. 4) of turbine bucket 200 is substantially covered by first rotor post 270 and the portion of bucket base portion 220 within rotor circumferential slot 740 (shown in FIG. 6) is visible. In various embodiments, a set of J-seals 208 may be disposed tangentially across first rotor post 270 and bucket base portion 220/forward portion 216 (shown in FIG. 4) in set of J-Seal grooves 218 (shown in FIG. 5). Set of J-seals 208 may connect to rotor posts 270 and turbine buckets 200, thereby axially, radially, and/or circumferentially restraining bucket base portion 220 within rotor 210 and/or seal portions of flow 7 from bucket shank slot 740. In one embodiment, shown in FIG. 9, a turbine bucket 204 may include a bucket platform 830 having a chamfered edge 890. Chamfer 890 may facilitate rotor cooling (e.g., negative root reaction cooling) by allowing a cooling flow 807 (shown in phantom)(e.g., steam) to enter downstream relative to working fluid flow path 7 (shown in FIG. 8) and pass along the dovetail between bucket base portion 220 and rotor 210/first rotor post 270. In another embodiment, a set of notches 207 and/or apertures 209 (shown in phantom) may be formed in bucket platform 830 to allow cooling flow 807 to access the dovetail.

Figure 10:
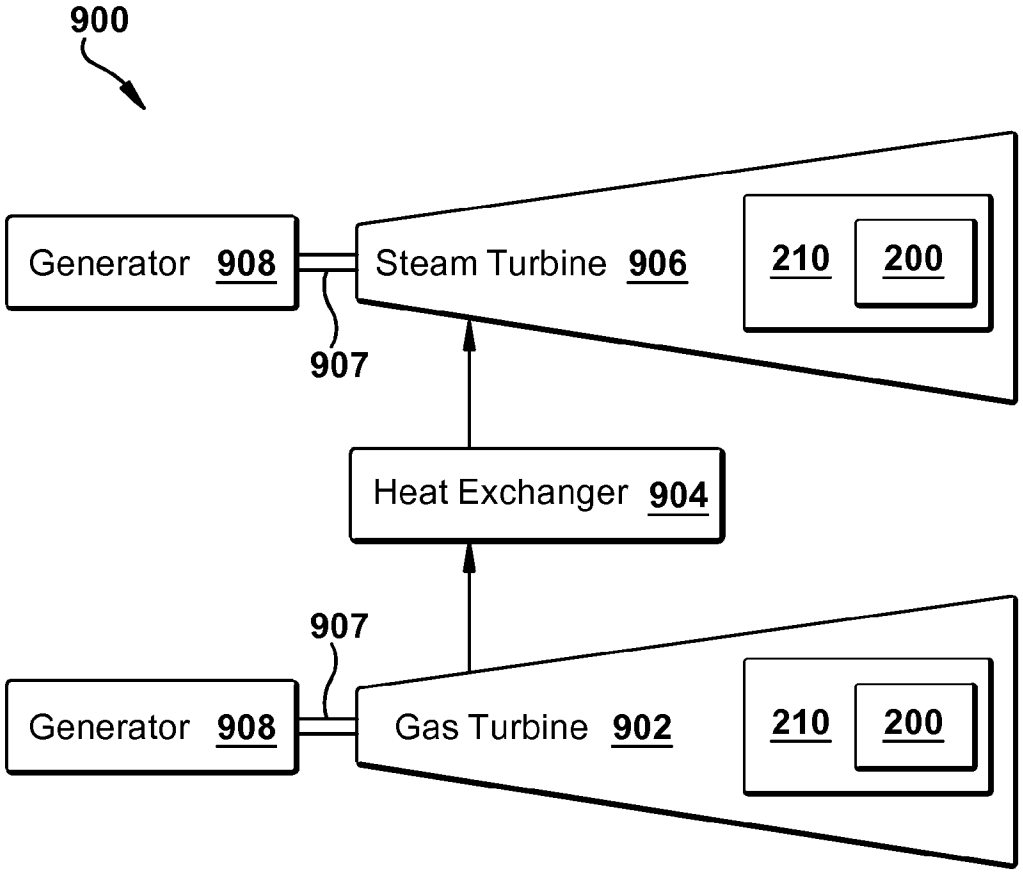
FIG. 10 shows a schematic block diagram illustrating portions of a combined cycle power plant system according to embodiments of the invention.
Figure 11:
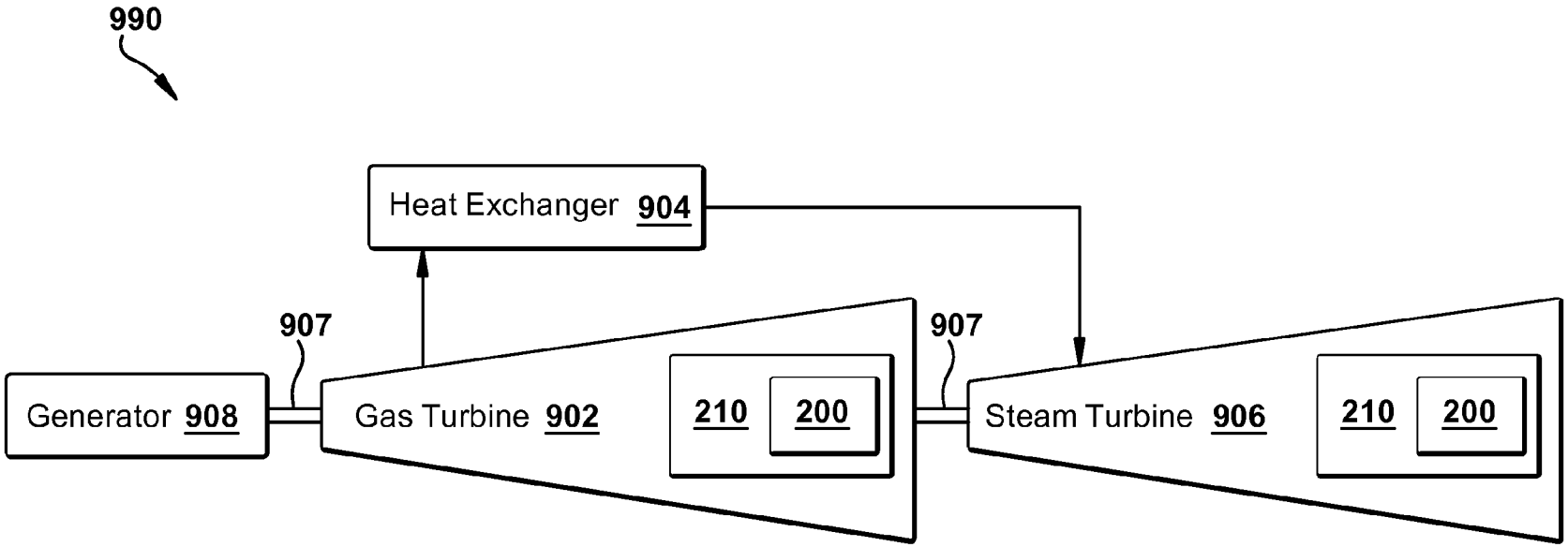
FIG. 11 shows a schematic block diagram illustrating portions of a single-shaft combined cycle power plant system according to embodiments of the invention.

Turning to FIG. 10, a schematic view of portions of a multi-shaft combined cycle power plant 900 is shown. Combined cycle power plant 900 may include, for example, a gas turbine 902 operably connected to a generator 908. Generator 908 and gas turbine 902 may be mechanically coupled by a shaft 907, which may transfer energy between a drive shaft (not shown) of gas turbine 902 and generator 908. Also shown in FIG. 10 is a heat exchanger 904 operably connected to gas turbine 902 and a steam turbine 906. Heat exchanger 904 may be fluidly connected to both gas turbine 902 and a steam turbine 906 via conventional conduits (numbering omitted). Gas turbine 902 and/or steam turbine 906 may include drum rotor 210 and/or turbine bucket 200 of FIG. 4 or other embodiments described herein. Heat exchanger 904 may be a conventional heat recovery steam generator (HRSG), such as those used in conventional combined cycle power systems. As is known in the art of power generation, HRSG 904 may use hot exhaust from gas turbine 902, combined with a water supply, to create steam which is fed to steam turbine 906. Steam turbine 906 may optionally be coupled to a second generator system 908 (via a second shaft 907). It is understood that generators 908 and shafts 907 may be of any size or type known in the art and may differ depending upon their application or the system to which they are connected. Common numbering of the generators and shafts is for clarity and does not necessarily suggest these generators or shafts are identical. In another embodiment, shown in FIG. 11, a single shaft combined cycle power plant 990 may include a single generator 908 coupled to both gas turbine 902 and steam turbine 906 via a single shaft 907. Steam turbine 906 and/or gas turbine 902 may include drum rotor 210 and/or turbine bucket 200 of FIG. 4 or other embodiments described herein.

The turbine buckets and rotors of the present disclosure are not limited to any one particular turbine, power generation system or other system, and may be used with other power generation systems and/or systems (e.g., combined cycle, simple cycle, nuclear reactor, etc.). Additionally, the turbine buckets and rotors of the present invention may be used with other systems not described herein that may benefit from the stability, ease of installation and securing ability described herein.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A turbine bucket comprising:

a bucket base portion shaped to complement a corresponding individual axial bucket shank slot in a first rotor post of a turbine rotor, the bucket base portion including:

a forward portion shaped to extend axially upstream of a first stage circumferential slot of the rotor into the corresponding individual axial bucket shank slot in the first rotor post;

a circumferential protrusion formed in an aft end of the bucket base portion and shaped to connect to a circumferential slot in the rotor, and a set of axial protrusions formed on tangential sides of the bucket base portion and shaped to connect to the corresponding individual axial bucket shank slot in the first rotor post; and a bucket platform extending radially outboard from the bucket base portion, the bucket platform configured to connect to a vane.

2. The turbine bucket of claim 1, wherein the set of axial protrusions extend along the bucket base portion and define a set of contact surfaces shaped to distribute a load to the rotor across an axial length of the bucket base portion.

3. The turbine bucket of claim 1, wherein the forward portion is sized to extend through the first rotor post via the corresponding individual axial bucket shank slot, and the forward portion is sized to substantially fill the corresponding individual axial bucket shank slot and form a substantially planar axial surface with the first rotor post and a substantially planar radial surface with the first rotor post.

4. The turbine bucket of claim 1, wherein the bucket platform defines a chamfer between the turbine bucket and a second rotor post of the rotor, the chamfer shaped to allow a flow to access the corresponding individual axial bucket shank slot.

5. The turbine bucket of claim 1, wherein the bucket platform defines at least one aperture through the turbine bucket, the at least one aperture shaped to allow a flow to access the corresponding individual axial bucket shank slot.

6. The turbine bucket of claim 1, wherein the circumferential protrusion has a dovetail shape shaped to connect to a circumferentially-oriented ridge disposed on a second rotor post of the rotor.

7. The turbine bucket of claim 1, wherein the set of axial protrusions have a dovetail shape configured to connect to a set of axially-oriented ridges disposed on the first rotor post of the rotor.

8. The turbine bucket of claim 1, wherein the bucket base portion defines a set of grooves shaped to connect to a set of J-seals.

9. A turbine, comprising:

a stator;

a working fluid passage substantially surrounded by the stator; and a rotor located radially inboard of the working fluid passage and including a first rotor post and a second rotor post, the rotor including:

a set of turbine buckets connected to the rotor via the first rotor post and the second rotor post, the set of turbine buckets including:

a bucket base portion shaped to complement a corresponding individual axial bucket shank slot in the first rotor post, the bucket base portion including:

a forward portion shaped to extend upstream of a first stage circumferentially-oriented slot of the rotor into the corresponding individual axial slot of the first rotor post;

a circumferentially-oriented protrusion formed in an aft end of the bucket base portion and shaped to connect to the rotor, and a set of axially-oriented protrusions formed on tangential sides of the bucket base portion and shaped to connect to the rotor; and a bucket platform extending radially outboard from the bucket base portion, the bucket platform configured to complement a vane.

10. The turbine of claim 9, wherein the forward portion is sized to extend through the first rotor post via the corresponding individual axial bucket shank slot, the forward portion substantially filling the corresponding individual axial bucket shank slot and forming a substantially planar axial surface with the first rotor post and a substantially planar radial surface with the first rotor post.

11. The turbine of claim 9, wherein the bucket platform defines a chamfer between the turbine bucket and a second rotor post of the rotor, the chamfer configured to allow a flow to access the corresponding individual axial bucket shank slot.

12. The turbine of claim 9, wherein the circumferentially-oriented protrusion has a dovetail shape configured to connect to a circumferentially-oriented ridge disposed on the second rotor post of the rotor.

13. The turbine of claim 9, wherein the set of axially-oriented protrusions have a dovetail shape configured to connect to a set of axially-oriented ridges disposed on the first rotor post of the rotor.

14. The turbine of claim 9, wherein the bucket base portion defines a set of grooves shaped to connect to a set of J-seals.

15. A rotor comprising:

an axle configured to extend through a flow path of a turbine and support a plurality of turbine components;

a first rotor post disposed circumferentially about the axle and shaped to partially define a first stage circumferential retention slot for a set of turbine buckets, the first rotor post defining a plurality of individual bucket shank slots which extend axially through the first rotor post and are shaped to correspond to the ser of turbine buckets; and a second rotor post disposed circumferentially about the axle and located downstream of the first rotor post relative to a working fluid flow in the turbine, the second rotor post shaped to complement the first rotor post and partially define the first stage circumferential retention slot.

16. The rotor of claim 15, wherein the plurality of individual bucket shank slots include a set of axial ridges shaped to connect to complementary turbine buckets.

17. The rotor of claim 15, wherein the second rotor post includes a set of circumferential ridges shaped to connect to a set of circumferential protrusions defined in complementary turbine buckets.

18. The rotor of claim 15, wherein the plurality of individual bucket shank slots have a substantially dovetail shape.

19. The rotor of claim 15, wherein the first rotor post includes a plurality of rotor post portions separated by the plurality of individual bucket shank slots.

20. The rotor of claim 15, wherein a surface of the plurality of individual bucket shank slots is shaped to direct a cooling flow there through.

* * * * *